US006502693B1

(12) United States Patent
Percival

(10) Patent No.: US 6,502,693 B1
(45) Date of Patent: Jan. 7, 2003

(54) COVER FOR AN OPEN-TOPPED CONTAINER FOR FOOD AND/OR DRINK

(76) Inventor: David Richard Percival, 2 Greenfield Road, Middleton on the Wolds, Nr. Beverley, N. Yorkshire, Y025 Sul. (GB)

( * ) Notice: Subject to any disclaimer, the term of this patent is extended or adjusted under 35 U.S.C. 154(b) by 0 days.

(21) Appl. No.: 09/622,969

(22) PCT Filed: Feb. 2, 1999

(86) PCT No.: PCT/EP99/00671

§ 371 (c)(1),
(2), (4) Date: Nov. 6, 2000

(87) PCT Pub. No.: WO99/43572

PCT Pub. Date: Sep. 2, 1999

(30) Foreign Application Priority Data

Feb. 24, 1998 (GB) ..... 9803745

(51) Int. Cl.[7] ..... B65D 69/00

(52) U.S. Cl. ..... 206/223; 206/541; 206/548; 220/359.1; 220/910; 220/212

(58) Field of Search ..... 206/216, 223, 206/541, 548, 561, 567; 220/359.1, 359.2, 212, 910, 574, 575; 426/119, 128–130

(56) References Cited

U.S. PATENT DOCUMENTS

| | | | | | |
|---|---|---|---|---|---|
| 3,286,826 | A | * | 11/1966 | Stoll | 206/223 |
| 4,182,336 | A | * | 1/1980 | Black | 206/438 |
| 4,542,050 | A | | 9/1985 | Gallant | |
| 4,765,123 | A | * | 8/1988 | Caldwell | 53/469 |
| 4,850,508 | A | * | 7/1989 | Lee | 206/554 |
| 4,948,266 | A | * | 8/1990 | Bencic | 383/34 |
| 5,913,606 | A | * | 6/1999 | Nicholson | 383/11 |
| 6,199,803 | B1 | * | 3/2001 | Schafer | 248/99 |

* cited by examiner

*Primary Examiner*—Shian Luong
(74) *Attorney, Agent, or Firm*—Nawrocki, Rooney & Sivertson, P.A.

(57) ABSTRACT

A cover on an open-topped container of food and/or drink either attached to the open top of the container by a first adhesive means forming a receptacle that can be slipped over the container. The cover has second adhesive means thereon so that, when the cover has been entirely or partially removed from the container to open the cover, it will remain attached to, or be attachable to, the container by the second adhesive means and can hang down, as a receptacle, from one side of the container, for receiving waste material.

23 Claims, 6 Drawing Sheets

(a)

(b)

(c)

COVER FOR AN OPEN-TOPPED CONTAINER FOR FOOD AND/OR DRINK

This invention relates to a cover for an open-topped container for food and/or drink, for example for use on an aircraft or in a cafeteria or fast-food restaurant, and also to a method of using the cover.

It is standard on an aircraft flight to serve food and/or drinks in a tray-like container for the food and drink. The food may be wrapped, eg. in paper, card, clingfilm, or plastics, or in cartons, or a plate or other item of crockery which can be of china, porcelain or the like or of plastics, paper or cardboard material. Similarly, the drink may be in a glass or plastics bottle, can or carton. In addition, the container may contain items for the passenger who is to consume the food or drink such as a glass, flatware (knife, fork, spoon), serviette, salt and pepper mill and other such items. Typically, the container is of moulded plastics material and may have internal compartments for subdividing the interior space into individual areas for containing respective items or groups of items, together with a rigid moulded lid or cover, typically transparent. When the passenger wants to eat his meal, he needs usually to take the lid off to gain access to the food and drink items. However, space is limited on the passenger fold-down table to place the lid. Furthermore, as the passenger eats the meal, waste material is produced such as wrappings, cartons, used serviettes, printed menus, drink cans or bottles, bottle tops, discarded food and the like, which need to be temporarily stored somewhere, preferably separate from the food and drink still to be consumed. With the conventional tray-like container described this can be a juggling act, making use of space vacated by the initial consumption of food and drink. Still further, these waste materials can be bulky and often extend to a greater height than that occupied by the carefully packaged and arranged items before the container was opened, especially because some of these items (e.g. a discarded serviette) have a large volume and also because the non-disposable items such as glasses plates and flatware also occupy a certain volume. Because of the greater height occupied by the waste material, it is often not possible to reposition the lid in the container to assist collection. Furthermore, waste items are often inadvertently dropped on the floor which can soil the interior furnishings of the aircraft and require manpower and effort to clear them up.

These and related problems can also arise in cafeterias, fast food restaurants and other similar situations.

According to the invention from another aspect, there is provided a cover for an open-topped container for food and/or drink, said cover being attached to, or having first adhesive means on the outside thereof for attachment to, said container and being in the form of, or having second adhesive means for converting the cover into, a receptacle arranged so that, when it has been removed from the open top of the container, it will be attached to, or be attachable to, the container and can hang down, as a receptacle, from one side of the container for receiving waste material.

According to the invention from another aspect, there is provided a cover for an open-topped container for food and/or drink, said cover being attached to, or having first adhesive means on the outside thereof for attachment to, said container and being in the form of, or having second adhesive means for converting the cover into, a receptacle arranged so that, when it has been removed from the open top of the container, it will be attached to, or be attachable to, the container and can hang down, as a receptacle, from one side of the container for receiving waste material.

Effectively, with such an arrangement, the cover of the container, which normally serves to keep the food covered and fresh, doubles up as a waste receptacle. Furthermore, after the container has been opened, the cover hangs in a position in which waste material can be readily and conveniently inserted without hindering the person's ability to continue consuming his meal and drink.

Preferably, the cover is attached to the container in the region of one end thereof and is releasably attached, along its edges which are not attached to said one edge of the container, to the other edges of the container, such that the cover can be released from the container to provide access to food and/or drink therein while remaining attached in the region of said one edge of the container.

It is especially convenient if the releasable attachment of the cover to the container is provided by first adhesive bonding, said cover being attached to said container in the region of said one edge by second adhesive bonding of greater bonding strength than that of said first adhesive bonding. In this way, the weaker first adhesive bonding yields readily to the cover being pulled back from its end remote from said one end, while the stronger second adhesive bonding remains intact to maintain the attachment in the region of said one end to the container. The first and second adhesive bonding can each be provided by contact adhesive applied to corresponding surface areas of the cover and container. Then, the cover can be partially or completely peeled back from the container to allow the latter to be filled, and then resealed to help keep the contents fresh and free from contamination, ready to serve to customers.

Suitably, in one embodiment the cover is in the form of a flexible film and the first adhesive bonding is such as to permit the film to be peeled back from the container and folded transversely back on itself with contacting side edges of the film united by the first adhesive bonding, thereby forming said receptacle. This construction is especially easy and cheap to manufacture, although the depth of the receptacle is only about half the corresponding dimension of the unfolded cover.

In another embodiment, the cover is in the form of a receptacle having a closed end located remote from said one edge of the container, and is provided with means for enabling said closed end to be released from attachment to said container. In one arrangement, such means comprises a pull-string, attached at one end to the closed end of said receptacle, extending within the receptacle, and passing out through its open end such that on pulling the pull-string, the cover becomes progressively separated from the container. In this embodiment, the depth of the receptacle is substantially the same as the corresponding dimension of the unfolded cover.

In either embodiment, the closed end of the receptacle may incorporate a stiffening member, to facilitate separation of the cover from the receptacle without tearing or distorting the receptacle. The stiffening member may incorporate a lifting tab serving as the means for enabling said closed end to be released from attachment to said container for facilitating initial opening of the container. In the second embodiment, this may be provided in addition to or as an alternative to the pull-string.

In a third embodiment, the cover is in the form of a receptacle for placing over and around an open-topped container and having releasable attachment means adjacent the open mouth of the receptacle for attachment in the region of one edge of an open-topped container after it has been removed from the container. Such a cover is very cheap to make, though it does require the customer himself to attach the waste receptacle adjacent the one edge of the container. Conveniently, the releasable attachment means comprises an adhesive strip with a peel-off cover strip. The cover strip serves to protect the adhesive strip, until such time as it is required to attach the receptacle to the container.

In all three embodiments, the cover may be formed from a flexible film. Where, in the second embodiment, the cover is in the form of a receptacle, the film assumes the form of a flattened tube closed at one end. The flexible film can be transparent, so that the contents of the container can be seen while the cover is in place. Alternatively, it may be preferred that the flexible film be opaque, so that rubbish inside the receptacle will not be visible.

In a preferred arrangement, sealing means, such as an adhesive strip with a protective cover, are provided for sealing the receptacle after waste material has been inserted into it.

For a better understanding of the invention and to show how the same may be carried into effect, reference will now be made, by way of example, to the accompanying drawings in which:

FIG. 5(*b*) is a corresponding view showing the cover further separated from the container;

FIG. 5(*c*) is a similar view, on a smaller scale, showing the cover fully separated from the container, hanging down from one edge of the container, which belongs to one passenger, in the space between that container and the one of the passenger sitting next to that one passenger, and serving as a receptacle for waste;

FIG. 5(*d*) shows the receptacle filled with waste material, sealed and folded over into the container for collection and disposal;

Figure 6:
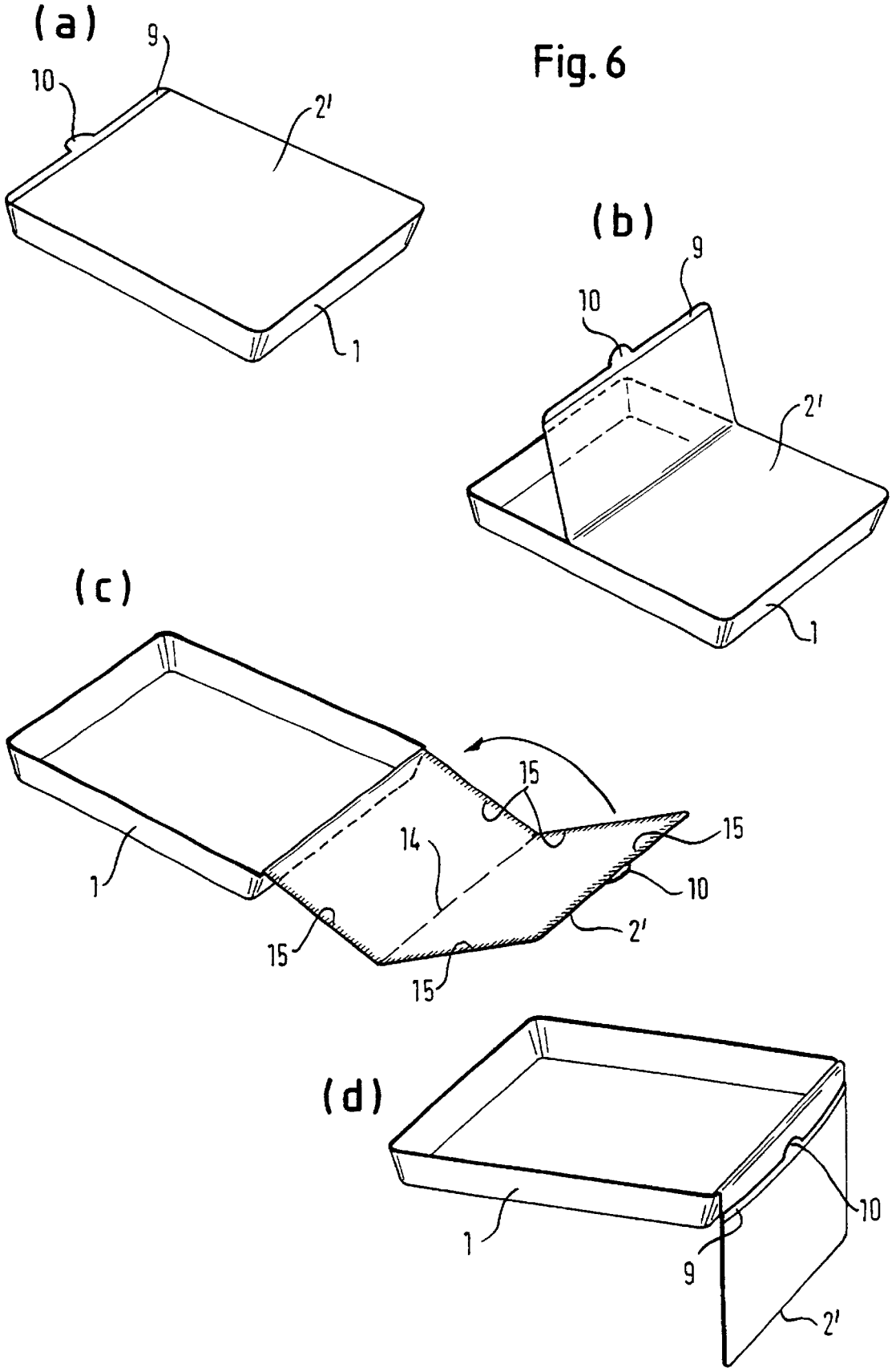
Figure 7:
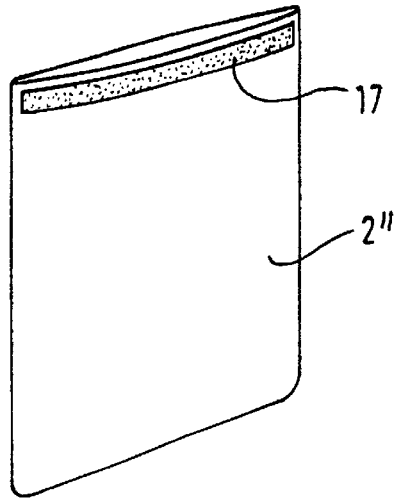
Figure 7:
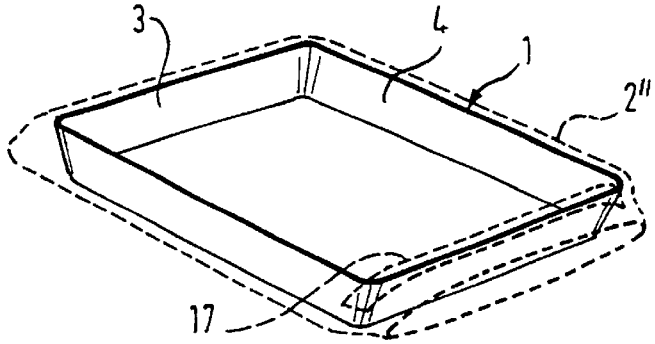
Figure 7:
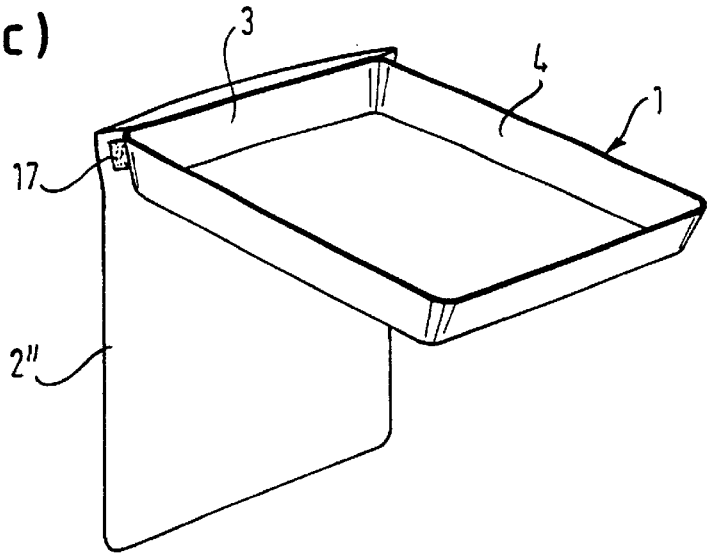

FIGS. 6(*a*)–6(*d*) are perspective views of a second embodiment showing the container with a flexible film cover in place (FIG. 6(*a*)), with the film partially peeled back (FIG. 6(*b*)), with the film fully peeled back and starting to be transversely folded back on itself (FIG. 6(*c*)), and with the film converted into a receptacle and hanging down from one edge of the container (FIG. 5(*d*)); and FIGS. 7(*a*)–7(*c*) are perspective views of a third embodiment, FIG. 7(*a*) showing a cover in the form of a waste receptacle, FIG. 7(*b*) diagrammatically showing the receptacle in place on and around the container, and FIG. 7(*c*) showing the receptacle attached to the container and hanging from one side of the container.

Referring firstly to FIGS. 1 to 4, there is shown a meal container 1, specially designed for use in an aircraft and being in the form of a tray, having a cover 2. The tray is suitably of moulded plastics material, being generally of rectangular shape, having a base 6, opposite end walls 3 and opposite side walls 4. As shown, the container may include an arrangement of internal walls defining differently sized discrete spaces or compartments 5 in which different provisions (food and possibly drink items) are separately stored. As discussed in the opening part of this specification, the container also includes durable items which can be used (such as china or porcelain crockery, metal flatware etc.) and disposable items which are to be disposed of after the meal has been eaten (such as wrappings, used serviettes, bottle tops, bottles, cartons and the like). These disposable items, together with uneaten food, food remains, empty bottle etc., constitute waste material to be temporarily stored for collection and disposal by cabin crew.

Figure 1:
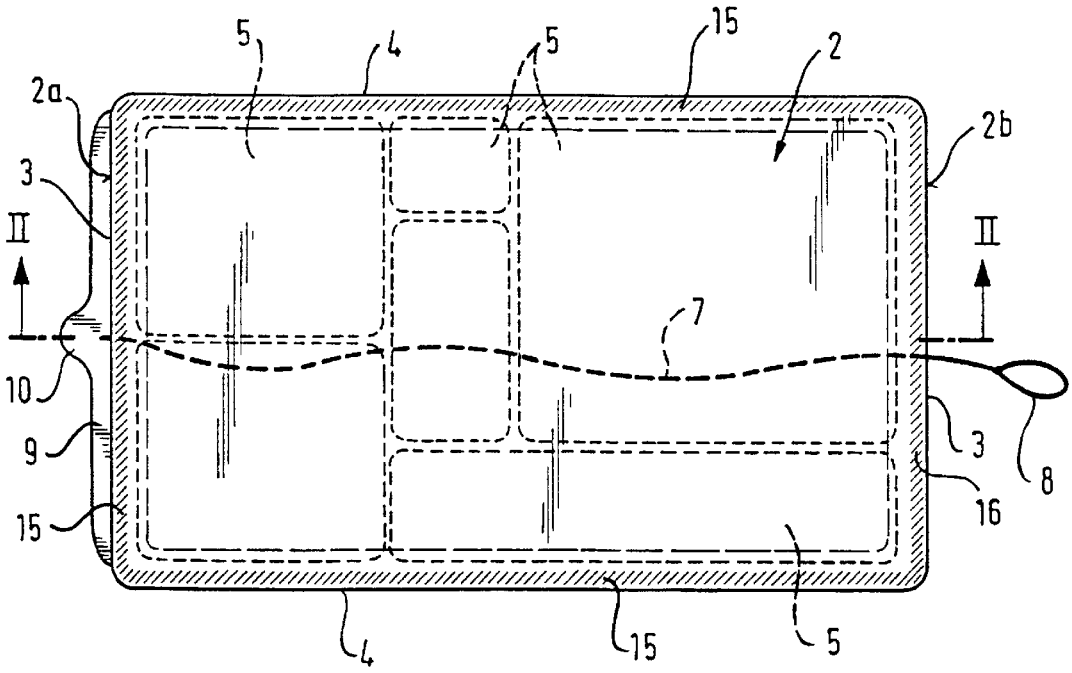
FIG. 1 is a diagrammatic plan view of an open-topped container for food and/or drink with cover in place, forming a first embodiment of the invention.
Figure 2:
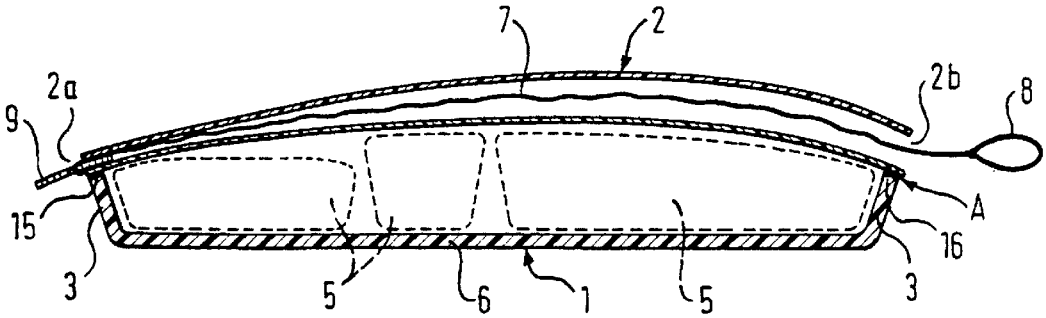
FIG. 2 is a diagrammatic vertical sectional view taken along the line II—II in FIG. 1.
Figure 3:
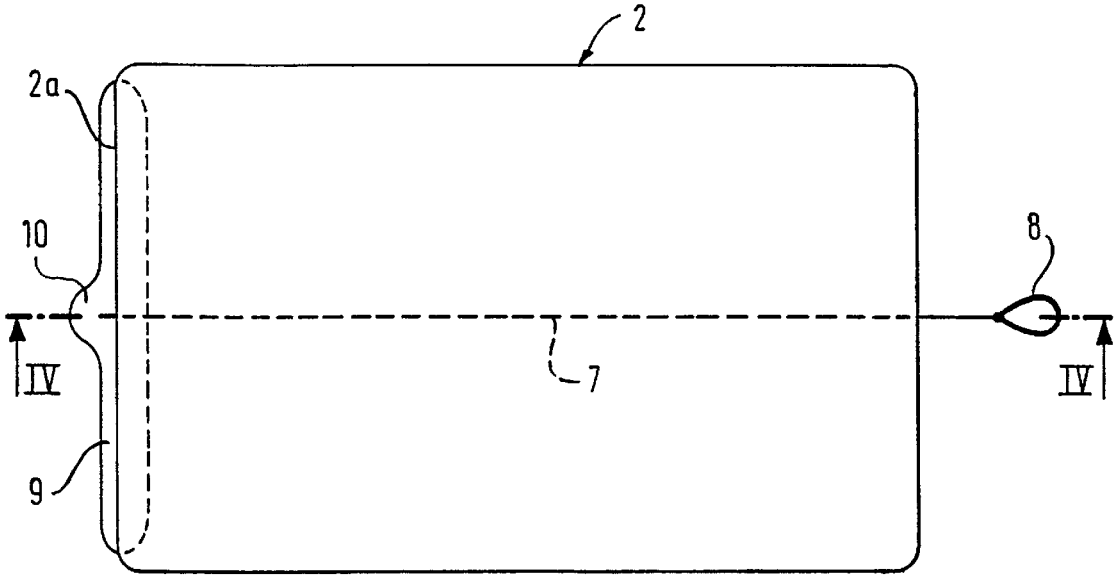
FIG. 3 is a diagrammatic plan view of the cover alone.
Figure 4:
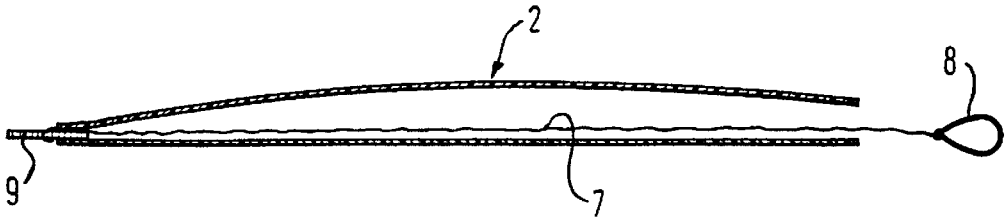
FIG. 4 is a diagrammatic vertical sectional view taken along the line IV—IV in FIG. 3.
Figure 5A:
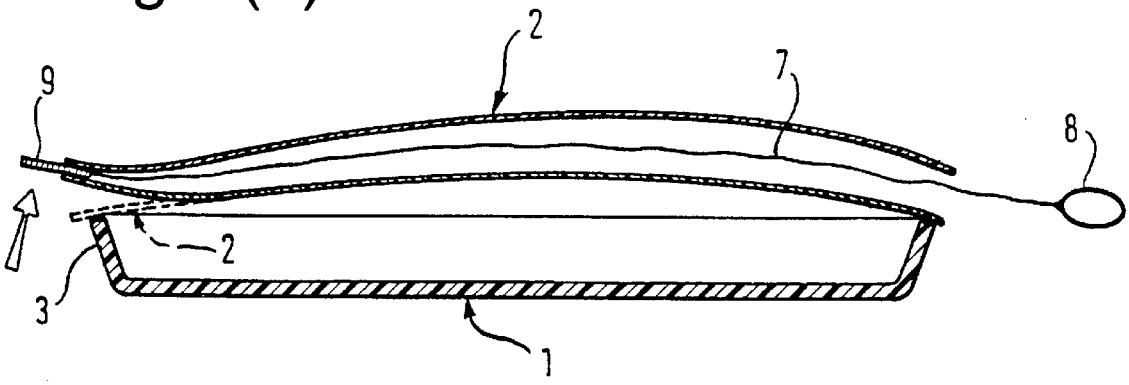
FIG. 5(*a*) is a vertical sectional view corresponding to FIG. 2 but showing the cover starting to be separated from the container.
Figure 5B:
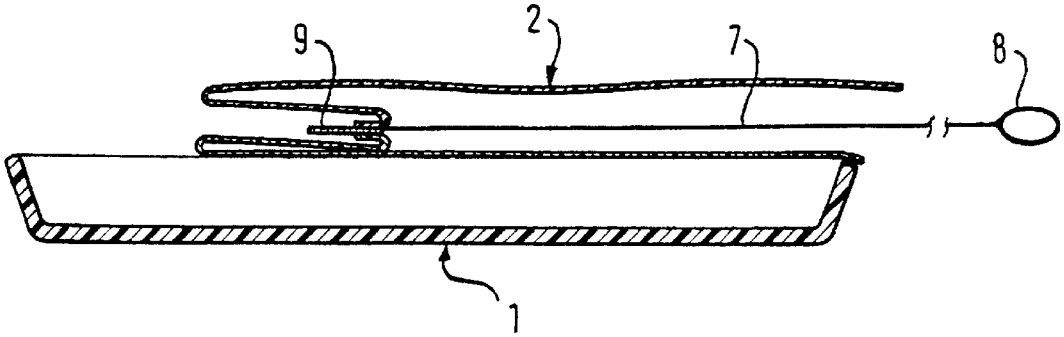
Figure 5C:
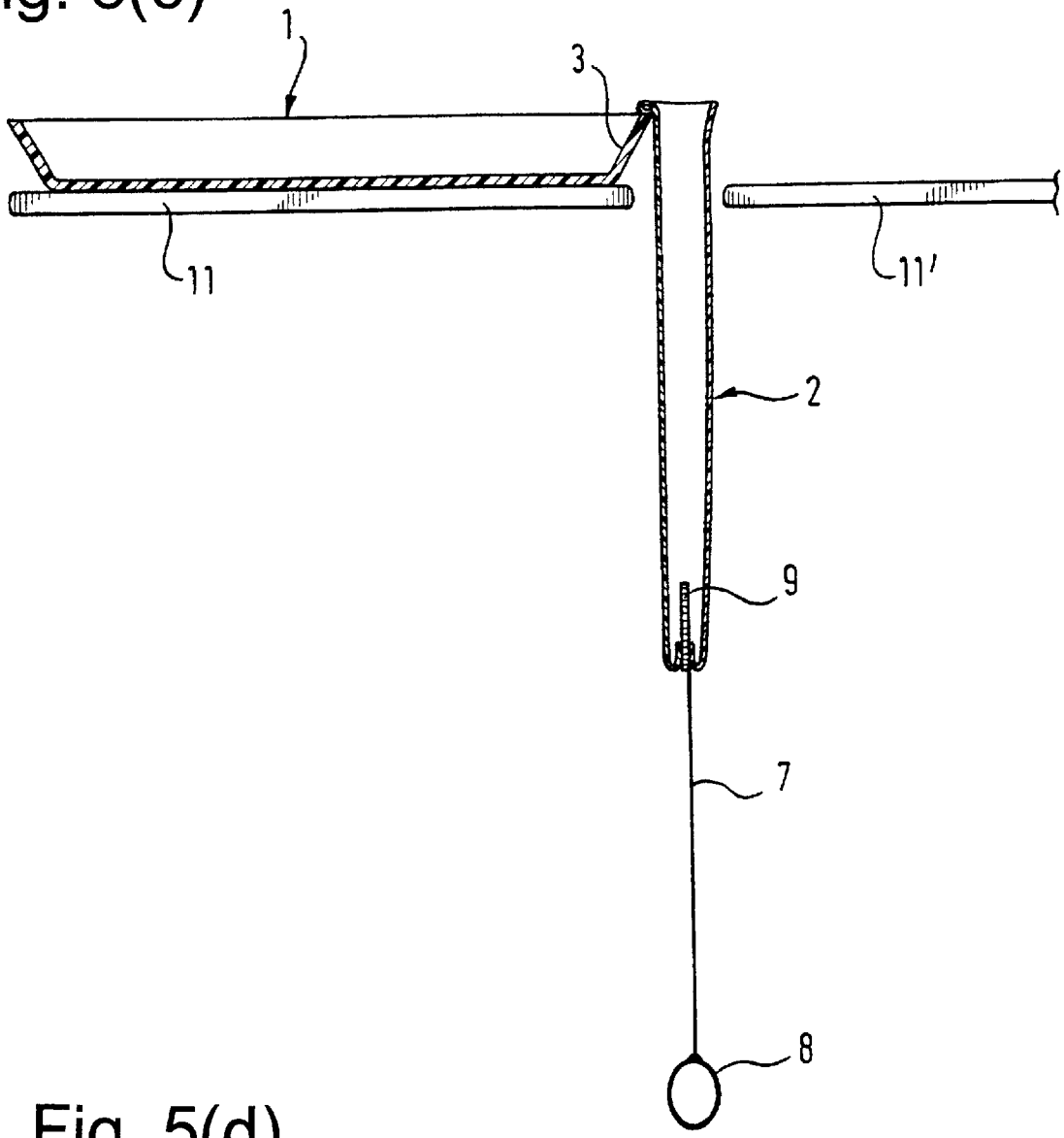
Figure 5D:
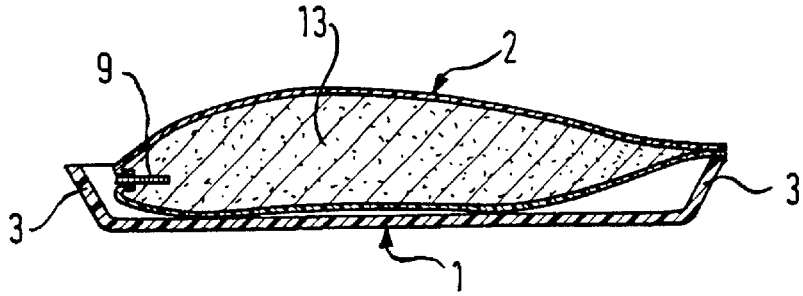

The cover 2 is in the form of a flattened tube of flexible material, e.g. a plastics material, sealed at one end 2*a* and open at the other 2*b*. The size and shape of the cover as seen in plan view is substantially identical to those of the container and the cover is bonded around its peripheral marginal edge region to the upper edge surfaces provided by the upstanding walls of the container. The bond is preferably provided by registering strips of contact adhesive on the cover 2 and container 1. The bond along one edge 3, the right-hand edge in FIGS. 1 and 2, is of relatively high strength and its position is indicated by the shaded area 16 in FIG. 1, whereas the bonding along the remaining three edges of the container is of lower strength, this bonding being indicated by the shaded areas 15 in FIG. 1. The weaker contact adhesive bond 16 can be broken by peeling an edge of the cover 2 away from the container 1, whether for initially inserting (food and drink) provisions, durable items, and disposable items into the container or for subsequently permitting access to enable the provisions in the container to be consumed. In the former case, the contact adhesive is such as to enable the cover to be resealed on the container after the provisions and utilities have been inserted, by applying contact pressure between the aligned adhesive strips on the cover and container. Such resealing helps to keep the food fresh and protected.

In order to facilitate the separation of the cover from the container, a pull-string 7 may be firmly attached at one end to the closed end 2*a* of the cover and passes centrally within the cover between the upper and lower walls thereof and out through the open mouth 2*b* of the cover. The free end of the pull-string terminates in a pull loop or ring 8, so that the customer can grip the pull-string more surely and comfortably. A stiffening member 9 may be provided at the closed end of the cover. The pull-string is secured at its end to the stiffening member, for example by a tied knot, adhesive bonding or other suitable securing means. The stiffening member is secured to the upper and lower walls of the cover in the region of its closed end 2*a*. For example, the stiffening member may, as shown, be located between the upper and lower cover walls and bonded to them. The function of the stiffening member 9 is to provide a firm anchoring point for the string and to prevent the cover walls from tearing or being otherwise damaged when the pull-string 7 is pulled.

As an alternative to the pull string or in addition thereto, the stiffening member may be formed with a lift tab 10 to be gripped by the customer.

Referring now to FIGS. 5(*a*)–5(*d*), these show successive stages in opening the sealed container.

Initially (FIG. 5(*a*)), the bottom or closed end 2*a* of the cover 2 has to be separated from the upper surface of the adjacent end wall 3. The lift tab 10 is ideal for this purpose though it is possible to effect the separation by an initial pulling on the pull loop or ring 8.

Further separation of the cover is effected by pulling the string, which draws the stiffening member inside the cover, between its upper and lower walls, as shown in FIG. 5(*b*). It will be appreciated that this action of the pull-string starts to turn the cover inside out. When the cover 2 has been completely separated along its two longitudinal edges from the container side walls 4, the cover, now turned fully inside out, can be left hanging from the upper edge surface of that end wall 3 of the container to which the cover remains attached. The reason why the bond strength between the cover and container at that end wall should preferably be greater than that for the other bonded connections before they were broken is to prevent the cover from being separated completely from the container.

It will be seen in FIG. 5(*c*) that the cover in this position is in the form of a receptacle or bag with its mouth located at the top. Furthermore, because the receptacle 2 is attached to the one end wall 3 of the container, it can hang in a convenient position, between the passenger's fold-down table 11 in the aircraft and that 11' of the next passenger, for the one passenger's waste 13 to be deposited.

The passenger, on finishing the meal, can fold the waste receptacle 2 up about its line of connection line to the container end wall 3 and over into the inside of the container, as shown in FIG. 5(*d*).

Suitably, the mouth of the receptacle can be sealed, to prevent rubbish from falling out of the receptacle. This can be effected in any suitable manner, such as using a contact adhesive strip with a protective tear-off cover strip on the inside surface of one or both walls of the cover adjacent its mouth.

It will be appreciated that with the waste 13 stored within the container receptacle 2 converted from the cover and located inside the container, waste cannot fall on the floor. Further, the cabin crew member merely has to collect the container with the waste neatly stowed away inside the container. It is not necessary to collect the container and part or all of the waste separately. Furthermore, the receptacle hanging down from the side of the container while the passenger is eating his meal provides a convenient and tidy way of temporarily storing waste produced as he eats his meal. It will further be recognised that the described embodiment can be cheap and simple to manufacture.

Another embodiment is shown in FIGS. 6(*a*)–6(*d*). Here the cover is in the form of a single sheet or film 2' attached to the container 1 in the same way as the twin walled cover 2 in the first embodiment.

FIG. 6(*a*) shows the sealed (unopened) container. In this embodiment, there is no draw-string. Rather, the lift tab 10 of the stiffening member 9 is used to effect the initial separation of the cover from the container and draw the cover back as shown in FIG. 6(*b*). When the cover has been fully separated from the container along the length of its longitudinal walls, the cover is folded back on itself along a transverse fold line 14 located approximately at the mid-region of the cover (FIG. 6(*c*)), until the folded side wall portion comes into contact with the remaining portion of the cover. The application of contact pressure will cause the contact adhesive strips, diagrammatically indicated at 15, to effect a bonded connection along the two sides, thereby converting the cover into a waste bag or receptacle 2, as shown in FIG. 5(*d*).

When the bag 2' has been filled, the line of adhesive 15 along the free end of the cover remote from the end connected to the container can be applied against the opposite portion of the cover, to seal the bag 2' at its mouth.

In addition to the advantages offered by the first embodiment, this second embodiment has the further benefit that it is even cheaper to manufacture, because its cover 2' is in the form of a single sheet rather than a flattened tube. Also, a pull-string and loop/ring is not required. However, since the bag 2' has a depth that is only half that of the bag of the first embodiment, its carrying capacity is reduced.

A third embodiment is shown in FIGS. 7(*a*) to 7(*c*). FIG. 7(*a*) shows the cover 2" in the form of a bag or receptacle of a size such that it can be slipped over the container 1 (see FIG. 7(*b*), in which the cover 2" is shown in dotted outline). If desired, the open mouth of the bag when slipped over the container can be sealed in any suitable manner. Applied on one side wall of the bag adjacent its mouth is an adhesive step 17, preferably covered with a protective tear-off strip (not specifically shown).

When the passenger wants to eat his meal, he firstly has to open the sealed mouth of the cover, where necessary, and the container 1 then needs to be taken out of the cover 2" and placed on the passenger fold-down table (not shown). After peeling off the protective strip from the adhesive strip 17 on the cover, the strip 17 is then applied to any one side or end wall 3 of the container, so that the cover 2" can hang down from that side wall and be used as a waste receptacle (FIG. 7(*c*)).

In the first and second embodiments as described, the manner of attachment of the cover to the container can be such as to permit the container to be opened, the contents for the container inserted, and then the cover re-attached. Alternatively, the contents can be inserted in an open-topped container and the cover releasably attached subsequently for the first time.

It is preferred in all embodiments that the receptacle hanging down from one side of the container can be sealed after all the waste has been placed in it. This can be achieved in the second embodiment by applying contact pressure to the open mouth of the receptacle so that the adhesive strip 15 along the far edge of the cover adheres to the opposite inside portion of the cover as described above. Alternatively, in all three embodiments, an adhesive strip with peel-off cover or the like can be provided on the inside of the receptacle adjacent its open mouth, for sealing the same.

In all embodiments, the container can be a plastics moulding and the cover (whether of single sheet or double wall design) preferably made of thin film flexible plastics material, transparent or opaque, or possibly paper.

What is claimed is:

1. A cover on an open-topped container for food and/or drink, comprising: a cover, being in the form of a receptacle, releasably attached to a top of an open container by an adhesive means to cover and seal said open top wherein said cover is partially removed from said container to open said container, while remaining attached to a portion of said container, wherein said receptacle hangs down from a side of said container, said receptacle being sealed by an adhesive.

2. A cover on an open-topped container for food and/or drink, comprising: a cover being in the form of a receptacle having a side, wherein said side is releasably attached to a top of a container by an adhesive means to cover and seal said top of said container, wherein said cover is partially removed from said container to open said container while remaining attached to a portion of said container, wherein said receptacle hangs down from a side of said container and is able to receive waste material therein.

3. A method of using a cover of an open-topped container for food and/or drink for collecting waste material resulting from consumption of said food and/or drink, comprising partially removing said cover, which initially is in the form of a receptacle attached to said container to cover and seal an open top of said container, from said container to open said container while said cover remains attached to a side of said container, said receptacle then hanging down from said side of said container for receiving waste material.

4. A cover on an open-topped container for food and/or drink, comprising: said cover being in the form of a receptacle releasably attached to said container by adhesive means to cover and seal an open top of said container so as to enable the cover to be partially removed from said container to open said container, while remaining attached to, said container, whereby said receptacle hangs down from a side of said container for receiving waste material.

5. A cover on an open-topped container for food and/or drink, comprising: said cover being in the form of a receptacle releasably attached to said container by adhesive means to close an open top of said container so as to enable the cover to be partially removed from while being maintained attached to, said container, whereby said receptacle hangs down from a side of said container for receiving waste material wherein said cover is formed from a flexible film.

6. A cover according to claim 5, wherein said flexible film is transparent.

7. A cover according to claim 5, wherein said flexible film is opaque.

8. A cover on an open-topped container for food and/or drink, comprising: said cover being in the form of a receptacle releasably attached to said container by adhesive means to close an open top of said container so as to enable the cover to be partially removed from while being maintained attached to, said container, whereby said receptacle hangs down from a side of said container for receiving waste material wherein sealing means are provided for sealing said receptacle after waste material has been inserted into it.

9. A cover on an open-topped container for food and/or drink, comprising: said cover being in the form of a receptacle releasably attached to said container by adhesive means to close an open top of said container so as to enable the cover to be partially removed from while being maintained attached to, said container, whereby said receptacle hangs down from a side of said container for receiving waste material wherein said cover is adhesively attached to said container proximate one edge thereof and is releasably attached by said adhesive means, along its edges which are not attached to said one edge of said container, to the other edges of said container, such that said cover can be partially removed from said container to provide access to food and/or drink therein while remaining attached proximate said one edge of said container.

10. A cover according to claim 9, wherein a releasable attachment of said cover to said container is provided by a first adhesive bonding, said cover being attached to said container proximate said one edge by second adhesive bonding of greater bonding strength than that of said first adhesive bonding.

11. A cover according to claim 10, wherein said receptacle has a closed end located remote from said one edge of said container and is provided with a means for enabling said closed end to be released from attachment to said container.

12. A cover according to claim 11, wherein said means for enabling said closed end to be released from attachment to said container comprises a pull-string attached at one end to the closed end of said receptacle, extending within said receptacle, and passing out through an open end of said receptacle remote from open end of said receptacle, such that on pulling said pull-string, said cover becomes progressively separated from said container.

13. A cover according to claim 12, wherein said end of the receptacle remote from said one end of said container incorporates a stiffening member.

14. A cover according to claim 13, wherein said stiffening member incorporates a lift tab.

15. A method of using a cover of an open-topped container for food and/or drink for collecting waste material resulting from consumption of said food and/or drink comprising: a cover, having a side that is initially attached to said container to cover and seal an open top of said container, being partially removed from said container to open said container, while remaining attached to said container and is converted into a receptacle which is allowed to hang down from one side of said container for receiving waste material.

16. A cover on an open-topped container for food and/or drink, comprising: a cover having a side that is releasably attached to said container to cover and seal an open top of said container, said cover having adhesive means thereon for converting said cover into a receptacle after said cover has been partially removed from said container to open said container while remaining attached to said container, said receptacle then hanging down from a side of said container for receiving waste material.

17. A cover on an open-topped container for food and/or drink, comprising: a cover having a side that is releasably attached to said container to close an open top of said container, said cover having adhesive means thereon for converting said cover into a receptacle after said cover has been partially removed from said container said receptacle then hanging down from a side of said container for receiving waste material wherein said cover is adhesively attached to said container proximate an edge thereof and is releasably attached by said second adhesive means, along its edges which are not attached to said one edge of said container, to said other edges of said container, such that said cover can be partially removed from said container to provide access to food and/or drink therein while remaining attached proximate said one edge of said container.

18. A cover according to claim 17, wherein a releasable attachment of said cover to the container is provided by first adhesive bonding, said cover being attached to said container proximate said one edge by second adhesive bonding of greater bonding strength than that of said first adhesive bonding.

19. A cover according to claim 18, wherein said cover is in the form of a film and said first adhesive bonding is such as to permit said film to be peeled back from said container and folded transversely back on said film with contacting side edges of said film united by said first adhesive bonding, thereby forming said receptacle.

20. A method of using a cover of an open-topped container containing food and/or drink for collecting waste material resulting from consumption of said food and/or drink, comprising: a cover, which is in the form of a receptacle, initially slipped over said container, to close an open top of said container and cover the food and/or drink contained therein, is removed from said container and is then reattached to said container, said receptacle then hanging down from one side of said container, said receptacle for receiving waste material being sealable using an adhesive strip.

21. A cover on an open-topped container for food and/or drink, comprising a cover being in the form of a receptacle slipped over a container to close an open top of said container and having an adhesive means in the form of a strip applied on a side wall of said receptacle and having an adhesive surface facing outwardly from said side wall, said cover being reattachable to said container by applying said side wall against a side of said container after said cover has been fully removed from said container so that said adhesive means adheres to said container and, said receptacle then hangs down from a side of said container.

22. A cover according to claim 21, wherein said adhesive strip is adjacent an open mouth of said receptacle for attachment proximate said edge of said open-topped container after said cover has been removed from the container.

23. A cover according to claim 22, wherein said adhesive strip is provided with a peel-off cover strip.

* * * * *